US006309175B1

(12) United States Patent
Hahnle et al.

(10) Patent No.: US 6,309,175 B1
(45) Date of Patent: Oct. 30, 2001

(54) PLATFORM COOLING IN TURBOMACHINES

(75) Inventors: Hartmut Hahnle, Kussaberg (DE); Kenneth Hall, Gainesville, GA (US); Sriwickrama Prithiviraj Harasgama, Kunten (CH); Konrad Vogeler, Küssaberg (DE)

(73) Assignee: ABB Alstom Power (Schweiz) AG, Baden (CH)

( * ) Notice: Subject to any disclaimer, the term of this patent is extended or adjusted under 35 U.S.C. 154(b) by 0 days.

(21) Appl. No.: 09/456,332

(22) Filed: Dec. 8, 1999

(30) Foreign Application Priority Data

Dec. 10, 1998 (EP) ..... 98 811 219

(51) Int. Cl.[7] ..... F01D 5/14

(52) U.S. Cl. ..... 415/115; 416/97 R; 416/193 A

(58) Field of Search ..... 416/97 R, 95, 416/193 A; 415/115, 116, 139, 138, 180

(56) References Cited

U.S. PATENT DOCUMENTS 5,244,345 9/1993 Curtis .
5,281,097 1/1994 Wilson et al. .
5,382,135 1/1995 Green .
5,634,766 * 6/1997 Cunha et al. ..... 415/115

FOREIGN PATENT DOCUMENTS

0357984A1 3/1990 (EP) .
0866214A2 9/1998 (EP) .

* cited by examiner

*Primary Examiner*—F. Daniel Lopez
*Assistant Examiner*—James M McAleenan
(74) *Attorney, Agent, or Firm*—Burns, Doane, Swecker & Mathis, L.L.P.

(57) ABSTRACT

The arrangements according to the invention and the method according to the invention serve to cool platforms in turbomachines. To this end, in two platforms 210, 210' arranged directly next to one another and having a separating gap 211 running between the platforms, at least one cooling passage 230 is arranged along the separating gap 211. In this case, the cooling passage 230 runs approximately parallel to the surface of the platforms 210, 210'. The cooling passage 230 is preferably designed as a slit-like recess in at least one side wall adjacent to the separating gap 211. If blades 220, 220' are arranged on the platforms 210, 210', the cooling passage 230 expediently runs approximately centrally between the blades. In addition, the cooling passage 230 preferably has a course similar to the course of the blade profile.

5 Claims, 3 Drawing Sheets

PLATFORM COOLING IN TURBOMACHINES

FIELD OF THE INVENTION

The invention relates to arrangements and a method for cooling platforms in turbomachines, in particular in gas turbines.

BACKGROUND OF THE INVENTION

The efficiency of turbomachines, in particular of gas turbines, can be increased by increasing the cyclic process parameters of the turbomachine. In this case, the relevant cyclic process parameters are the pressure and the temperature of the fluid. The fluid temperatures normally occurring nowadays during the operation of turbomachines, in particular in the turbine inlet region, are already markedly above the admissible material temperatures of the components. In this case, in particular the components forming the flow passage or projecting into the flow passage are directly exposed to the hot fluid flow. As a rule, the heat dissipation of the components, which is brought about by the heat conduction of the material, is not sufficient here in order to avoid an excess temperature of the components. Material temperatures which are too high first of all lead to a drop in the strength values of the material. In the process, crack formation often occurs in the components. In addition, in the event of the melting temperature of the material being exceeded, local or even complete destruction of the component occurs. In order to avoid these fatal consequences, care has to be taken in order to ensure that the component temperatures do not exceed the maximum admissible material temperatures. The flow passage of a turbomachine is often composed of platforms set side by side in an annular manner. The blades of turbomachines are often arranged on such platforms. One blade each is usually made in one piece with one platform. In particular in the case of stators, however, such platforms are often arranged in the form of a shroud of the blading on the blade tips. These platforms are therefore directly exposed to the hot fluid flow. In order not to exceed the maximum admissible material temperature of the platforms, the aim hitherto was normally to achieve over the passage height a temperature profile of the fluid, usually air, discharging from the combustion chamber, in the turbine inlet region. This temperature profile could be achieved via an admixture of cooling fluid into the marginal regions of the hot fluid flow in the discharge region of the combustion chamber. The fluid directly adjacent to the side walls and thus to the platforms, compared with the temperature of the core flow, therefore had a markedly reduced temperature. An excess temperature of the platforms could thus be avoided. On the one hand, a fluid-flow energy content varying over the passage height turns out to be a disadvantage of this method. This fluid-flow energy content varying over the passage height leads in turn to a non-uniform energy conversion in a following rotor and thus to non-uniform loading of the blading over the passage height. Resulting as a further disadvantage of this admixing of cooling fluid to the main flow is a reduction in the efficiency achievable and thus also a reduction in the power density of the turbomachine. For these reasons, a uniform temperature profile over the passage height is aimed at nowadays. In addition, modern combustion chambers are nowadays designed from the aspect of $NO_x$ reduction in such a way that admixing of secondary combustion air is no longer effected or only slight admixing of secondary combustion air is effected. This results in a very uniform temperature profile over the passage height. This in turn leads to an increase in the thermal loading of the components which are arranged downstream of the combustion chamber, in particular of the side walls and thus of the platforms. Here, it has hitherto been attempted to cool the platforms by blowing out a cooling fluid mostly directly upstream of the platforms. In this case, the cooling fluid is intended to form a cooling film on the top side of the platforms, as a result of which a fluidic separation between the hot fluid and the respective platform occurs. However, the effect of such cooling films, on account of the intermixing with the hot gas, is often quite restricted spatially. Changing pressure conditions of the hot-gas flow or even of the cooling fluid over the load range of a turbomachine likewise lead to a changed cooling film. In addition, in order to ensure adequate cooling, a relatively large cooling-fluid mass flow is required. This in turn leads to a reduction in the efficiency of the turbomachine.

SUMMARY OF THE INVENTION

The object of the invention is to cool platforms in an efficient and reliable manner.

This object is achieved according to the invention in that a cooling passage is arranged for the cooling by means of a cooling fluid at least in one section along a separating gap running between two platforms arranged next to one another. In this case, the cooling passage runs in at least one of the two platforms. The cooling fluid directed in the cooling passage expediently has a lower temperature than the adjacent platforms. As a result, a convectively induced heat transfer occurs between the platforms adjacent to the cooling passage and the cooling fluid and consequently cooling of the platforms occurs. It is found that cooling realized in this way is virtually independent of fluctuations in the operating state of the turbomachine. Furthermore, compared with the other cooling methods described above, a substantially smaller cooling-fluid mass flow is required in order to cool the platforms.

Here, the invention is mostly shown and described in arrangements which are used in turbomachines. In this case, however, this reference to arrangements in turbomachines does not constitute any restriction of the invention to this range of use, but only establishes, by way of example, an actual reference to a technical field. In principle the invention relates to all arrangements of two or more platforms.

Expediently, in this case, the cooling passage, at least in partial sections, runs approximately parallel to the platform surface. This ensures that a large region of the platform is cooled uniformly. It has been found that a temperature distribution which is uniform to a very large extent appears in the cooled regions of the platform. So-called hot-spots in the form of local overheating of the platforms are thereby avoided.

The platforms are often made in one piece or in several pieces with blades arranged on the platforms. The platforms may be arranged on the root or the tip of the blades. The platforms, set side by side, form one side wall or both side walls of the flow passage. In this case, it is advantageous to arrange the cooling passage approximately centrally between the blades. In an especially advantageous manner, the cooling passage is designed with a course approximately similar to the course of the blade profile. It is found that an excess temperature often occurs in the marginal regions and the free regions of the platforms. The free regions of a platform are the regions which in plan view or bottom view are not covered by a blade arranged on the platform. This particular risk to the marginal regions and the free regions with regard to excess temperature may be attributed to the fact that here, on account of small wall thicknesses of the platforms, only slight heat dissipation takes place by heat conduction in the platform itself. In addition, cooling-fluid feed lines for the blade cooling, provided the blade is a fluid-cooled blade, often only run in the centre of the platforms through the platforms into the blades. However, these cooling-fluid feed lines into the blades lead to cooling of the respective platform only in their immediate vicinity. The marginal regions of the platform thus remain uncooled. It has been found that a cooling passage preferably arranged approximately centrally between the blades leads here to optimum cooling, in particular of the marginal regions of the platforms. As a result of the curved course of the profile of the blades, it is also expedient to arrange the cooling passage in the platforms with a course approximately similar to the course of the blade profile.

The cooling-passage course advantageously has at least one S-turn designed in such a way that at least some of the cooling fluid directed in the cooling passage flows over the separating gap. In this way, it is possible to cool at least partial sections of both platforms with only one cooling passage In particular in the case of the arrangement of blades on the platforms, only one cooling passage is thus necessary in order to cool the regions between each two blades.

In a configuration which is simple to realize from the point of view of production, the cooling passage is preferably designed as a slit-like recess in at least one platform side wall adjacent to the separating gap. The cooling passage is thus not designed as a closed cooling passage but is designed to be open towards the separating gap. Accordingly, the cooling fluid can also flow into the separating gap. This advantageously also leads to cooling of the side walls of the separating gap. Furthermore, the cooling fluid may be fed to the cooling passage in a simple manner via the separating gap. In an especially preferred manner, the cooling passage is formed from slit-like recesses in both platform side walls adjacent to the separating gap.

If the cooling passage is open towards the separating gap, it is expedient, by means of at least one sealing element arranged in the cooling passage, preferably a sealing strip inserted into the cooling passage, to seal off the cooling passage from a fluid, as a rule the hot fluid, in contact with the top side of the platforms. In this way, an outflow of the cooling fluid from the cooling passage is prevented.

Furthermore, a cooling passage open towards the separating gap, at least in a section along the separating gap, is advantageously subdivided into a sealing chamber and a cooling chamber. This subdivision of the cooling passage is preferably effected via a graduation of the passage height. The sealing chamber, for the arrangement of a sealing element, is expediently designed with a greater passage height. The cooling chamber, on the other hand, advantageously has a smaller passage height with at the same time a greater depth of penetration.

The cooling fluid is expediently supplied to the cooling passage upstream with regard to a main flow flowing over the platforms, whereas the outlet is expediently effected downstream. In this case, the cooling fluid can escape into the main flow or else even into a downstream gap. In some cases, it is also appropriate to continue to use the cooling fluid for cooling in a cooling passage.

BRIEF DESCRIPTION OF THE DRAWINGS

Exemplary embodiments of the invention are shown in the drawings. In this case, however, the invention is not restricted only to these exemplary embodiments but may also be realized in a manner differing from these exemplary embodiments. In the drawing.

DETAILED DESCRIPTION OF THE PREFERRED EMBODIMENTS

Figure 1:
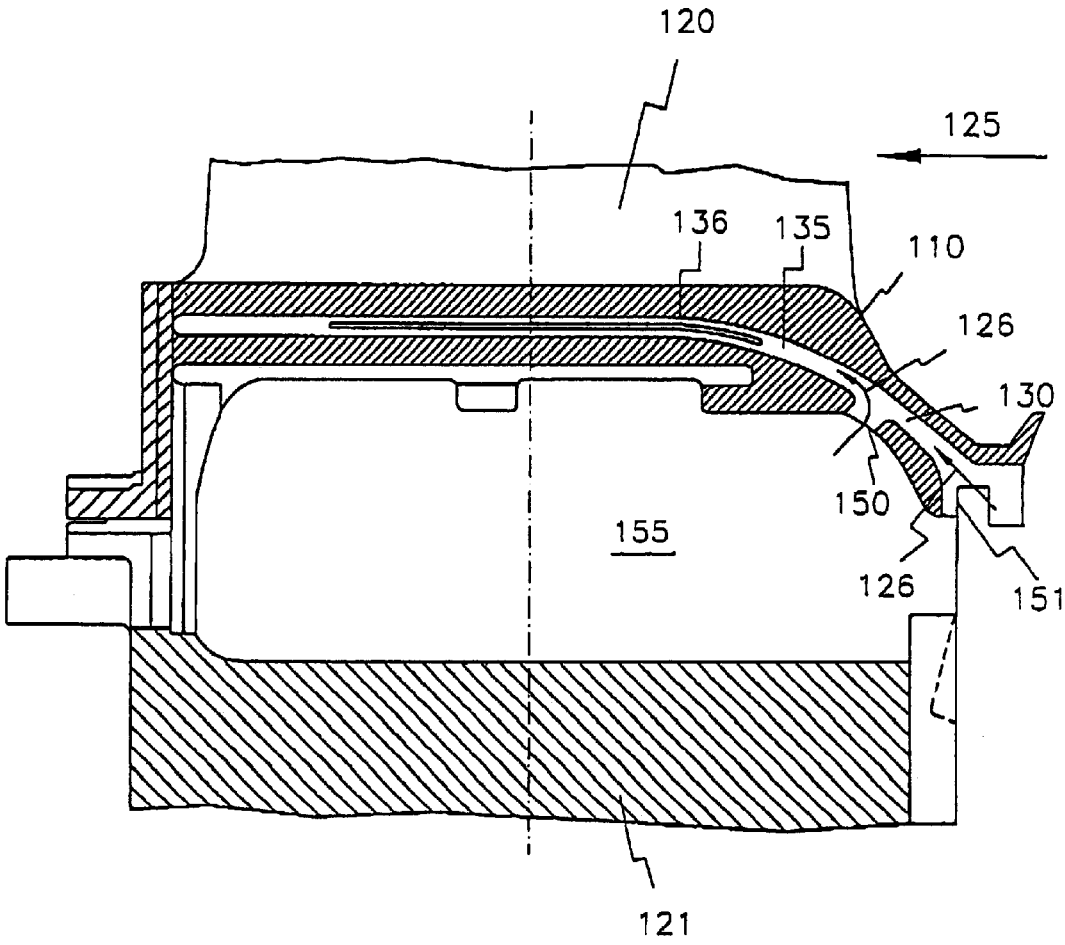
FIG. 1 shows a side view of a platform with a cooling passage arranged in the platform.

A platform 110 in a design typical of the use in a turbomachine is shown in side view in FIG. 1. Here, the hatching has not been used, as normal, to identify sectional areas but merely serves to clarify the representation. Here, according to the representation, the platform 110 is made in one piece with a blade 120 arranged on the platform. Furthermore, the platform 110 is shown in an arrangement with a rotor disc 121 of the turbomachine. This arrangement corresponds to the typical construction of a bladed turbine rotor of a turbomachine. However, only one of the blades, lined up on the circumference of the rotor disc and designed in each case with platforms, is shown. In this case, the platforms set side by side on the circumference of the rotor form the hub-side side wall of the flow passage of the turbomachine. Between the platform 110 shown and the next directly adjacent platform, a separating gap runs between the platforms. The hot fluid flow 125, as the. main flow of the turbomachine, flows from right to left in the representation along the top side of the platform 110. As a result, a direct heat exchange takes place between the hot fluid 125 and the platform 110. In the process, the temperature of the hot fluid 125, at least within the full-load range of the turbomachine, lies above the maximum admissible material temperature of the platform. In order to prevent an excess temperature of the platform 110, a cooling passage 130 is arranged according to the invention in the platform 110 shown. Here, the cooling passage 130 runs approximately parallel to the top side, facing the hot fluid flow, of the platform 110. According to the representation, the cooling passage 130 here is designed as a slit-like recess in the side wall of the platform 110. In this case, it is to be taken into account that, in FIG. 1, only one of the two platforms adjacent to the separating gap is shown. However, the complete cooling passage may extend proportionally to both platforms. In the same way, however, it is also possible for the cooling passage to run in only one side wall. To simplify the description, it is assumed below that the cooling passage extends only into the platform shown. Via a graduation of the passage height, the cooling passage 130 shown here is subdivided into two chambers open towards the separating gap. The front chamber is designed as a sealing chamber 135 having a large passage height. Furthermore, with a smaller depth of penetration into the platform than the sealing chamber, a cooling chamber 136 is arranged behind the sealing chamber. This cooling chamber 136 has a smaller passage height than the sealing chamber 135 and also its length extends only over one section of the sealing chamber 135. Here, the cooling passage 130 is fed with cooling fluid from two reservoirs. On the one hand, cooling fluid 126 flows out of a cooling-fluid reservoir 155, arranged between the platform and the rotor disc, via an opening 150 into the cooling passage 130.

A further possibility for supplying cooling fluid to the cooling passage 130 is obtained, here via the lateral opening 151 of the cooling passage. In the assembled arrangement of the turbomachine, the lateral opening 151 of the cooling passage opens out into the component gap between the rotor and the component arranged upstream with regard to the main flow 125. Here, therefore, the feeding of the cooling passage 130 with cooling fluid 126 is effected upstream with regard to the main flow 125. On the other hand, the outflow takes place at the downstream end of the cooling passage with regard to the main flow. The cooling passage 130 shown in FIG. 1 ends without a specially shaped outlet in the platform 110. The cooling fluid 126 escapes via the separating gap.

Figure 2:
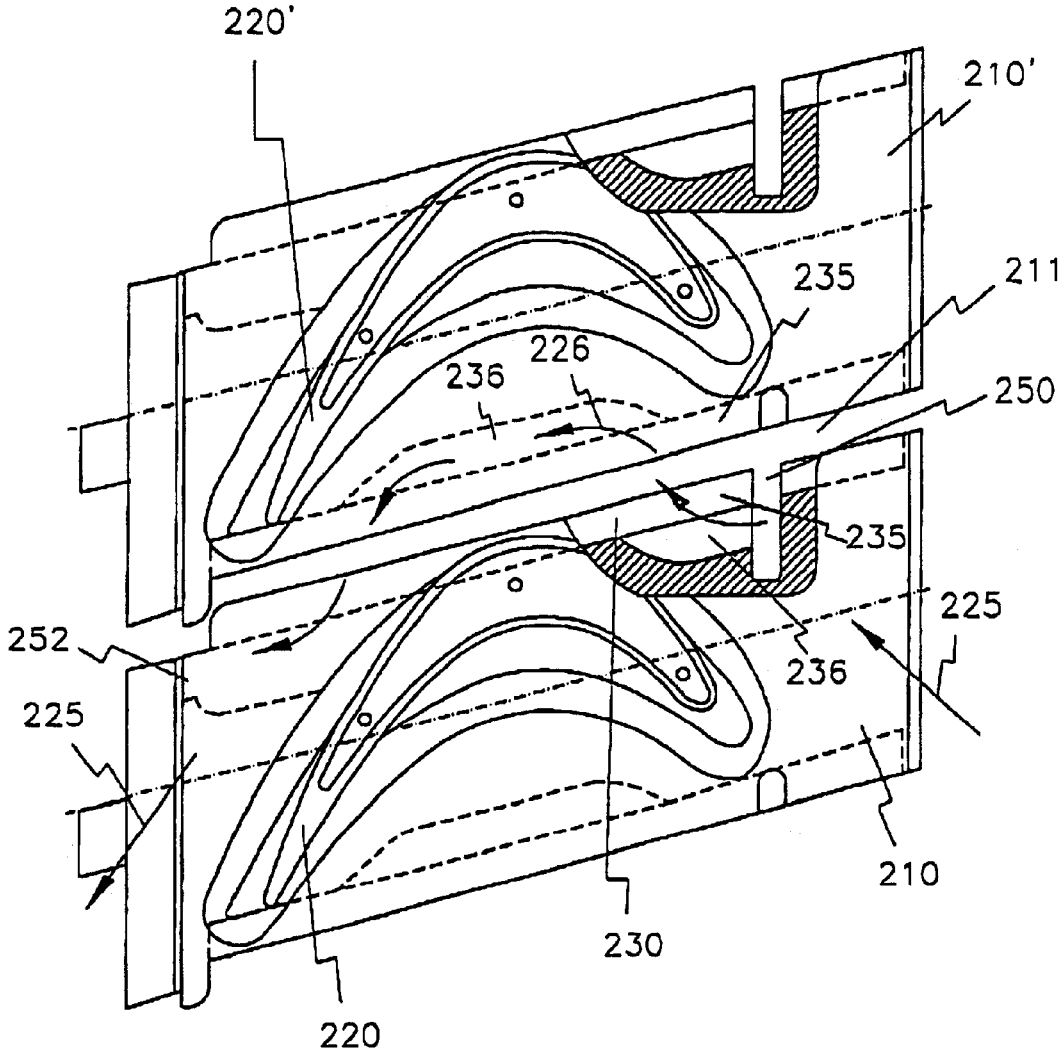
FIG. 2 shows a plan view of two platforms set side by side, with blades arranged on the platforms and a cooling passage arranged along the separating gap between the platforms.

FIG. 2 shows a plan view of two platforms 210, 210' arranged next to one another. In each case, a blade 220, 220' is arranged on each platform. In this case, the platforms 210, 210' are made in one piece with the blades 220, 220'. The three-dimensionally shaped blades 220, 220' are shown via sections at the blade root as well as in the centre section plane of the flow passage and also in plan view. Furthermore, the blades 220, 220' here are designed as cooled turbine blades. A separating gap 211 runs between the platforms 210, 210'. According to the invention, a cooling passage 230 is arranged along the separating gap 211 in those side walls of the platforms 210, 210' which are adjacent to the separating gap 211. Here, the cooling passage 230 consists of slit-like recesses in the side walls of both platforms 210, 210'. In the embodiment shown, the arrangement of the cooling passage 230 has been selected in such a way that the cooling passage 230 runs approximately centrally between the blades 220, 220' and in the process has a course similar to the blade profile. This course, similar to the blade profile, of the cooling passage 230 is achieved owing to the fact that the course of the cooling passage 230 has two S-turns along the separating gap 211. These S-turns are arranged in such a way that in each case at least some of the cooling fluid 226 directed in the cooling passage 230 flows over the separating gap 211. As a result of the course of the cooling passage 230 in accordance with FIG. 2, optimum cooling of the marginal regions and of the free regions of the platforms 210, 210' is achieved. In this case, the free regions of a platform are those regions which in plan view are not covered by a blade arranged on the platform. To this end, the cooling passage 230, in accordance with the region to be cooled, has a depth of penetration which varies along the separating gap 211 in the respective platform 210, 210'.

The cooling passage 230 shown in FIG. 2 is additionally subdivided into a sealing chamber 235 and a cooling chamber 236. In this case, the sealing chamber 235 consists of slit-like recesses, which are arranged with approximately the same depth of penetration, constant along the separating gap 211, in both side walls adjacent to the separating gap 211. Furthermore, the sealing chamber 235, compared with the cooling chamber 236, has a greater passage height. This feature cannot be seen on account of the perspective of the representation in FIG. 2. Likewise, the sealing element, expediently to be arranged in the sealing chamber, is not depicted in FIG. 2. This sealing element seals off the cooling passage from the hot fluid flow on the top side of the platforms. The cooling chamber 236, in the same way as the sealing chamber 235, is designed as a slit-like recess but with a smaller passage height. On the other hand, compared with the sealing chamber, the cooling chamber 236, as shown in FIG. 2, has a greater depth of penetration in the platforms 210, 210'. The feeding of the cooling passage 230 with cooling fluid 226, with regard to the hot fluid flow 225, is effected at the upstream end of the cooling passage 230 via a longitudinal slot 250 from a reservoir on the underside. At the end of the cooling passage 230, the cooling fluid 226 flows out of the cooling passage 230 via a discharge opening 252 into a downstream component gap (not shown in FIG. 2).

Figure 3:
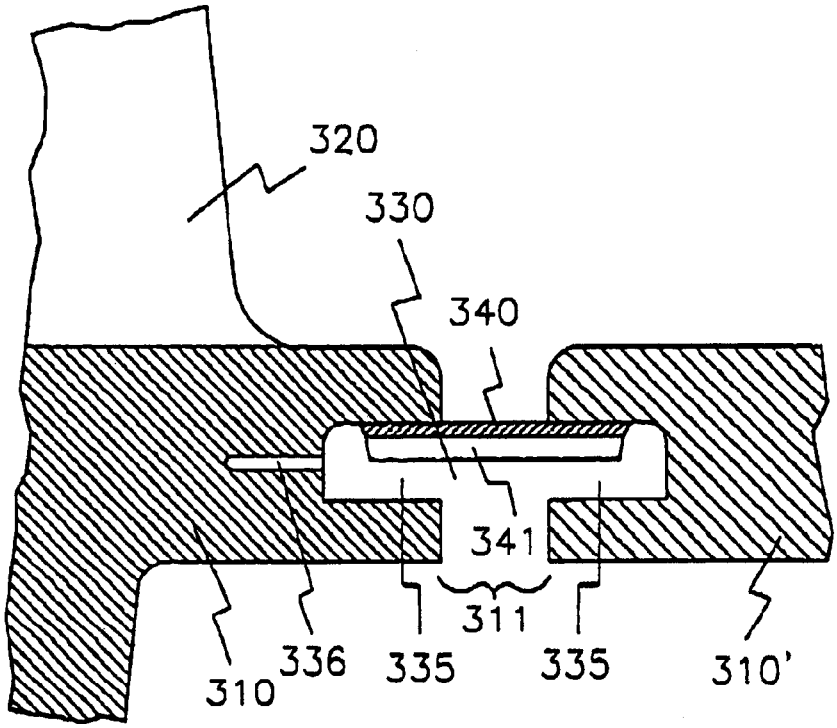
FIG. 3 shows a section through two platforms arranged next to one another, with a cooling passage arranged in the platforms.

Sealing off of the cooling passage 330 is shown in FIG. 3 as a section through two platforms 310, 310' arranged next to one another. Here, the cooling passage 330 is formed from slit-like recesses in both side walls, adjacent to the separating gap, of the platforms 310, 310'. The first platform 310 is again made in one piece with a blade 320 arranged on the platform. The cooling passage 330 is subdivided via a graduation of the passage height into a sealing chamber 335 and a cooling chamber 336. Here, a sealing strip 340 is inserted into the sealing chamber 335 in such a way that it seals off the cooling fluid flowing in the cooling passage 330 from a fluid in contact with the top sides of the platforms. The sealing strip 340 has a flange 341 at its rear end. Here, this flange 341 serves as the guide for the sealing fluid when flow takes place over the separating gap 311.

What is claimed is:

1. Platforms of a turbomachine, comprising:

at least two platforms arranged next to one another, with a separating gap running between the platforms, wherein a cooling passage is arranged in at least one section of at least one platform to cool the at least two platforms by means of a cooling fluid, and wherein the cooling passage is designed as a slit-like recess in at least one side wall adjacent to the separating gap.

2. Platforms of a turbomachine, comprising:

at least two platforms arranged next to one another, with a separating gap running between the platforms, wherein a cooling passage is arranged in at least one section of at least one platform to cool the at least two platforms by means of a cooling fluid, and wherein the course of the cooling passage has at least one S-turn designed such that at least some of the cooling fluid directed in the cooling passage flows over the separating gap.

3. Platforms according to claim 1, wherein the cooling passage, by means of at least one sealing element arranged in the cooling passage, preferably a sealing strip inserted into the cooling passage, is sealed off from a fluid in contact with the top side of the platforms.

4. Platforms according to claim 3, in which the cooling passage, at least in a section along the separating gap, is subdivided into a sealing chamber and a cooling chamber via a graduation of the passage height.

5. Method of cooling platforms, comprising the steps of:

arranging at least two platforms directly next to one another with a separating gap running between the platforms; and directing a cooling fluid along the separating gap in a cooling passage extending to both platforms, wherein the cooling passage is designed as a slit-like recess in at least one side wall adjacent to the separating gap.

* * * * *